US005890834A

United States Patent [19]

Waldenberger

[11] Patent Number: 5,890,834

[45] Date of Patent: Apr. 6, 1999

[54] VIBRATORY PLATE MACHINE WITH A WATER SUPPLY SYSTEM AND MEHTOD OF USING THE SAME

[75] Inventor: David J. Waldenberger, Menomonee Falls, Wis.

[73] Assignee: Wacker Corporation, Menomonee Falls, Wis.

[21] Appl. No.: 789,757

[22] Filed: Jan. 28, 1997

[51] Int. Cl.[6] ..... E01C 19/32; E01C 19/30

[52] U.S. Cl. ..... 404/133.1; 404/133.05

[58] Field of Search ..... 404/133.05, 133.1, 404/133.2, 111, 117, 129; 415/90, 206, 179, 185, 223 B; 239/543, 548, 550, 566

[56] References Cited

U.S. PATENT DOCUMENTS

| | | | |
|---|---|---|---|
| 3,782,845 | 1/1974 | Briggs et al. | 404/133.1 |
| 3,814,533 | 6/1974 | Buck | 404/133.1 |
| 4,421,435 | 12/1983 | Zemke et al. . | |
| 4,614,486 | 9/1986 | Bragagnini | 404/117 |
| 4,766,920 | 8/1988 | Gurth | 415/90 |
| 4,852,773 | 8/1989 | Standlick et al. | 222/504 |
| 5,657,928 | 8/1997 | Jian | 239/566 |

FOREIGN PATENT DOCUMENTS

| | | |
|---|---|---|
| WO 93/09296 | 5/1993 | European Pat. Off. . |
| 06212605 | 8/1994 | Japan . |
| 855050 | 11/1960 | United Kingdom . |

OTHER PUBLICATIONS

Wacker Corporation brochure: *Asphalt Vibratory Plates*, Mar., 1996.

Wacker Corporation brochure: *Vibratory Plates*, Jan., 1995.

Stone Construction Equipment, Inc. brochure: *Vibratory Plate*, 1993.

*Primary Examiner*—Tamara L. Graysay
*Assistant Examiner*—Sunil Singh
*Attorney, Agent, or Firm*—Nilles & Nilles

[57] ABSTRACT

A water supply system is adapted to spray lubricant, typically water, onto an asphalt surface in front of an asphalt vibratory plate machine at a generally constant rate regardless of the level of lubricant in the system's storage tank and regardless of machine inclination. The water is routed to a nozzle assembly of the water supply system through a pump that is preferably driven by the exciter of the asphalt vibratory plate machine. The pump is configured to provide adequate pressure with minimal increase in the machine's overall weight, complexity, or manufacturing expense. The nozzle assembly includes a spray bar which is configured to spray water uniformly across the entire compaction path but which is shorter than the baseplate of the machine so as to avoid snagging on neighboring obstructions.

17 Claims, 4 Drawing Sheets

VIBRATORY PLATE MACHINE WITH A WATER SUPPLY SYSTEM AND MEHTOD OF USING THE SAME

BACKGROUND OF THE INVENTION

1. Field of the Invention

The invention relates to compacting machines and, more particularly, relates to an improved water supply system for a vibratory plate machine of the type used to smooth and compact hot or cold mix asphalt.

2. Discussion of the Related Art

Vibratory plate machines, usually known simply as "vibratory plates" are widely used in the construction and landscaping industries for the compaction of granular materials. Applications include the compaction of sand, gravel, or crushed aggregate for foundations, footings, or driveways; base preparation for concrete slabs, asphalt parking lots, etc.; and the compaction of either hot or cold mix asphalt during patch or repair of streets, highways, sidewalks, parking lots, etc. The typical vibratory plate machine includes a baseplate that performs the actual compacting operation and a console that is mounted on the baseplate so as to support an engine and its associated equipment. An eccentric shaft device, commonly known as an exciter, is located on the baseplate in an underlying relationship to the console and is driven by the engine to impart vibrations to the baseplate, thereby compacting materials on which the machine rests. Movement of the machine is controlled by a handle assembly extending upwardly and rearwardly from the console.

In hot or cold mix asphalt compaction applications, the machine is additionally provided with a water supply system for spraying water or another lubricant onto the asphalt surface immediately in front of the machine to prevent the asphalt from congealing on the baseplate. The typical water supply system includes 1) a storage tank mounted directly or indirectly on the console and 2) a nozzle assembly or spray bar mounted on the front end of the baseplate. A tube connects a bottom opening in the storage tank to a central opening of the spray bar such that water flows by gravity from the storage tank to the spray bar. Water is discharged from the spray bar and onto the asphalt surface via a plurality of spray orifices directed toward the asphalt surface. Spraying of water onto the asphalt surface directly in front of the asphalt finishing machine serves to lubricate the surface and to prevent or at least inhibit sticking or congealing of asphalt on the baseplate.

Water supply systems of the described type suffer from noticeable drawbacks and disadvantages due to the fact that they are gravity fed rather than pressurized.

For instance, it is desirable to maintain a generally constant, designated flow rate of water out of the spray orifices so that the proper amount of water is sprayed onto the asphalt surface for lubrication. Spraying too much water might degrade the quality of the compacted surface. Spraying too little water might hinder the lubrication effectiveness of the system. Spraying water at a generally constant rate is impossible with gravity fed systems of the above-described type because the flow rate of water from the spray bar is primarily a function of the static pressure head within the storage tank which, of course, falls steadily as the storage tank empties. Accordingly, sizing the tubes and orifices properly to assure an ideal water flow rate from a full storage tank might lead to inadequate lubrication when the storage tank is nearly empty.

Moreover, the absence of pressure hinders the ability of the system to spray a uniform pattern when the machine is operating on a side slope because the unpressurized water tends to run to and be discharged from the downstream end of the spray bar. This uneven flow leads to a reduction or even absence of lubricant flow from the orifices near the upstream end of the spray bar.

The need therefore exists to provide a water supply system for an asphalt vibratory plate machine that assuredly sprays water or another lubricant onto the asphalt surface at a generally uniform rate regardless of machine inclination.

OBJECTS AND SUMMARY OF THE INVENTION

It is therefore a primary object of the invention to provide a water supply system for an asphalt vibratory plate machine that pressurizes a lubricant such as water prior to spraying the lubricant onto the asphalt surface so as to assure lubricant application at a generally constant rate regardless of machine inclination and regardless of the lubricant level in the storage tank.

In accordance with a first aspect of the invention, this object is achieved by providing a lubricant supply system including a storage tank, a nozzle assembly, and a pump. The storage tank is configured for mounting on the console and has an outlet formed therein. The nozzle assembly is configured to spray lubricant on the asphalt surface in front of the asphalt vibratory plate machine and has an inlet and at least one spray orifice. The pump has an inlet in fluid communication with the outlet of the storage tank and an outlet in fluid communication with the inlet of the nozzle assembly.

Preferably, in order to minimize expense and to minimize modifications to the existing machine design, the pump is configured to be driven by the exciter. In this case, the pump preferably comprises an impeller which is fixable to an end portion of an eccentric shaft of the exciter so as to rotate with the eccentric shaft. The pump further includes a volute casing which forms an end cap of a housing of the exciter.

Another object of the invention is to provide an improved nozzle assembly for a lubricant supply system of an asphalt vibratory plate machine.

In accordance with another aspect of the invention, the nozzle assembly comprises a tubular spray bar which is configured for mounting on the baseplate of the asphalt vibratory plate machine proximate a front edge surface thereof. The spray bar comprises an inlet which 1) is in fluid communication with the outlet of the pump and 2) forms the inlet of the nozzle assembly. The spray orifice of the nozzle assembly is formed in a lower portion of the spray bar, and a plurality of additional spray orifices are formed in the lower portion of the spray bar in a longitudinally spaced relationship to the spray orifice.

Preferably, the spray bar is shorter than a lateral width of the baseplate to avoid the spray bar from snagging on obstructions. The spray orifices include first and second end orifices and a plurality of intermediate orifices located longitudinally between the first and second end orifices. In order to assure water distribution across the entire compaction path of the machine, the first and second end orifices extend laterally outwardly at an acute angle with respect to a longitudinal centerline of the spray bar.

Yet another object of the invention is to provide a method of uniformly spraying a lubricant onto an asphalt surface in front of an asphalt vibratory plate machine regardless of lubricant level in the machine's storage tank and regardless of machine inclination.

In accordance with still another aspect of the invention, this object is achieved by propelling a vibratory plate machine over the asphalt surface, the vibratory plate machine including a baseplate and an exciter which is located above the baseplate. As the vibratory plate machine is being propelled over the asphalt surface, lubricant is sprayed onto the asphalt surface in front of the baseplate. The spraying step includes drawing lubricant from a storage tank and into a pump, the storage tank and the pump both being supported by the baseplate, then forcing lubricant from the pump to a nozzle assembly located adjacent a front edge surface of the baseplate, and then discharging lubricant from the nozzle assembly and onto the asphalt surface. Preferably, the steps of drawing lubricant and forcing lubricant are performed by driving the pump by the exciter.

These and other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a water supply system is adapted to spray lubricant, typically water, onto an asphalt surface in front of an asphalt vibratory plate machine at a generally constant rate regardless of the level of lubricant in the system's storage tank and regardless of machine inclination. The water is routed to a nozzle assembly of the water supply system through a pump that is preferably driven by the exciter of the asphalt vibratory plate machine. The pump is configured to provide adequate pressure with minimal increase in the machine's overall weight, complexity, or manufacturing expense. The nozzle assembly includes a spray bar which is configured to spray water uniformly across the entire compaction path but which is shorter than the baseplate of the machine so as to avoid snagging on neighboring obstructions.

2. System Overview

Figure 1:
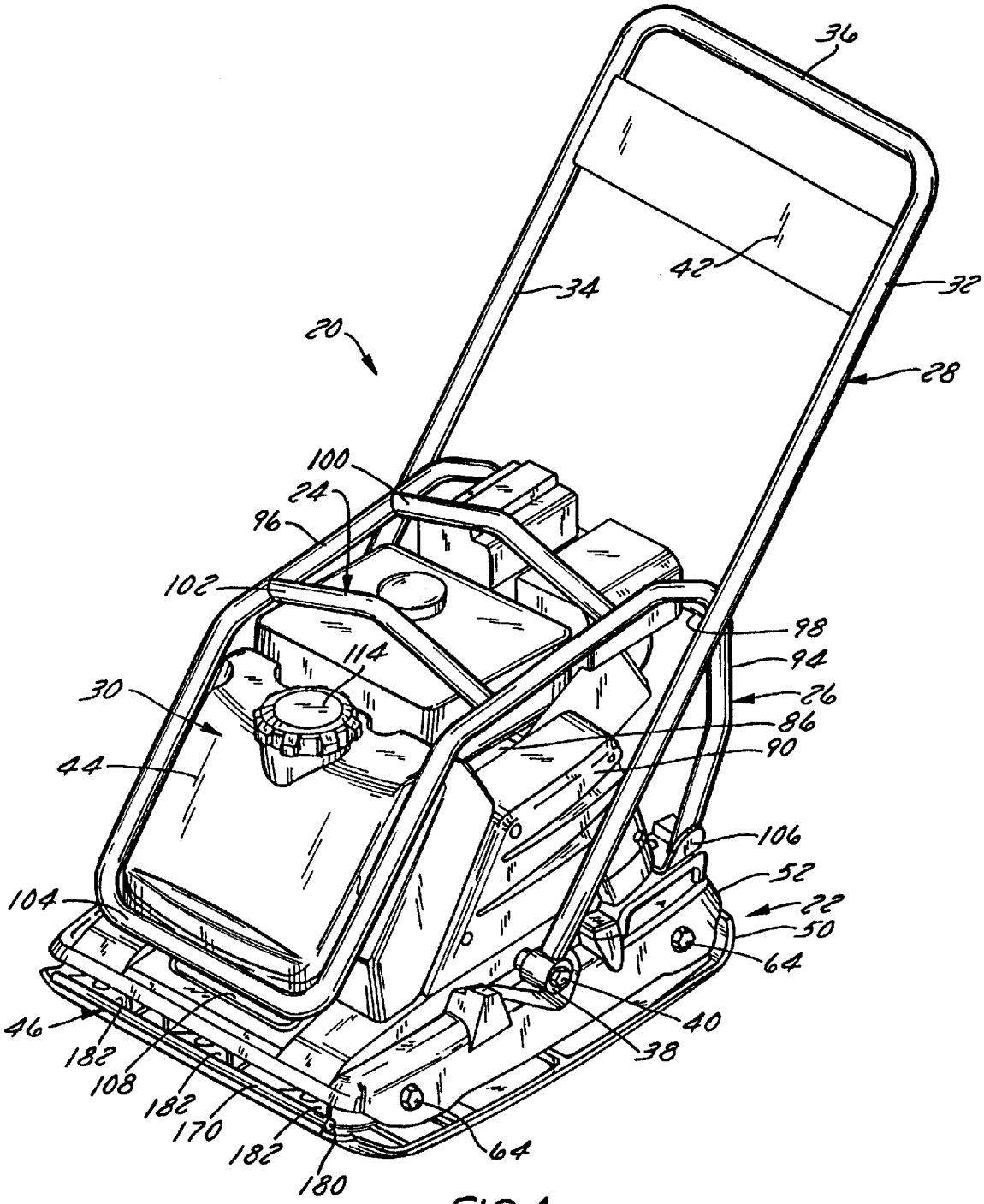
FIG. 1 is a perspective view of an asphalt vibratory plate machine incorporating a water supply system constructed in accordance with a preferred embodiment of the invention.
Figure 2:
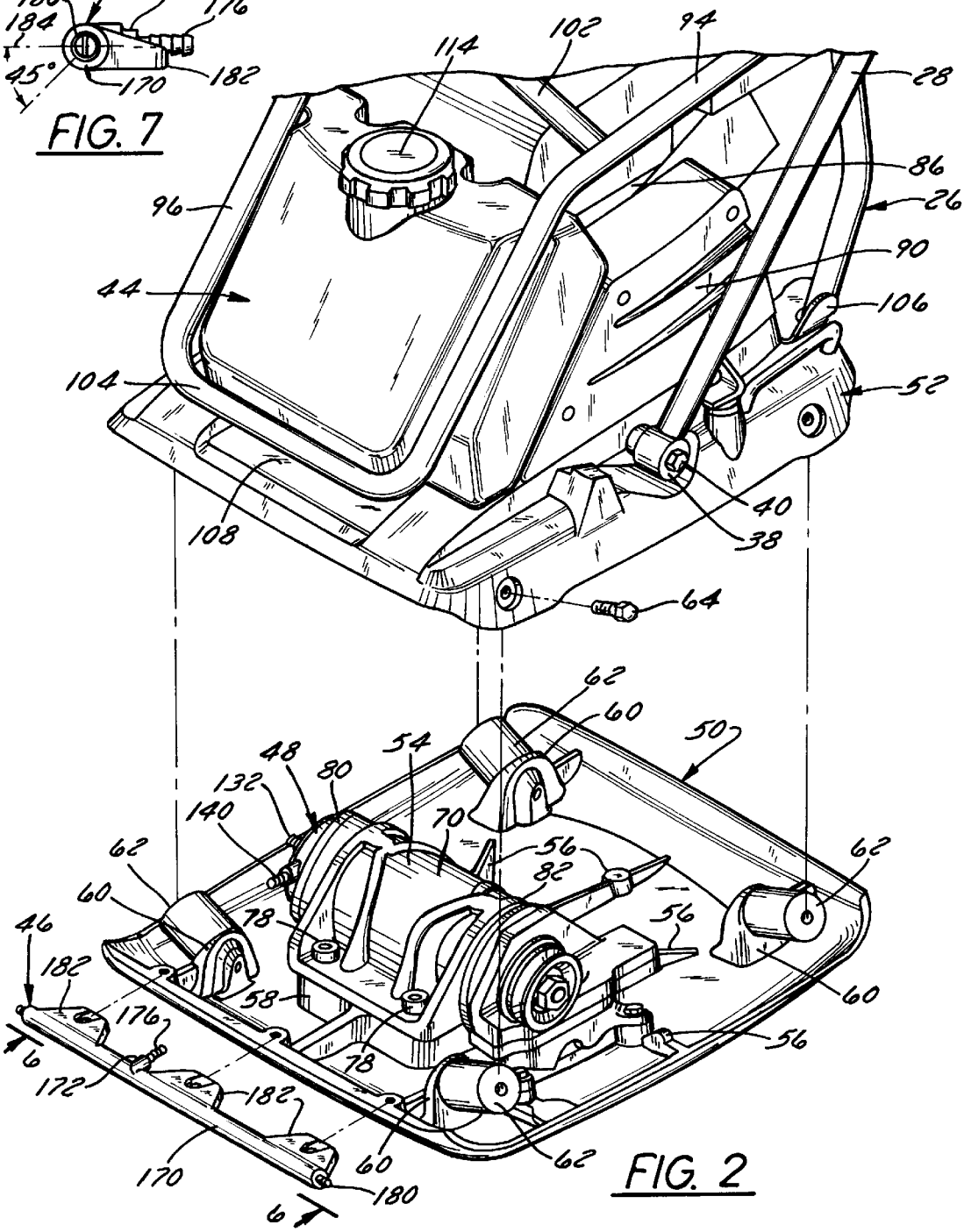
FIG. 2 is a partially exploded perspective view of a portion of the asphalt vibratory plate machine of FIG. 1.
Figure 3:
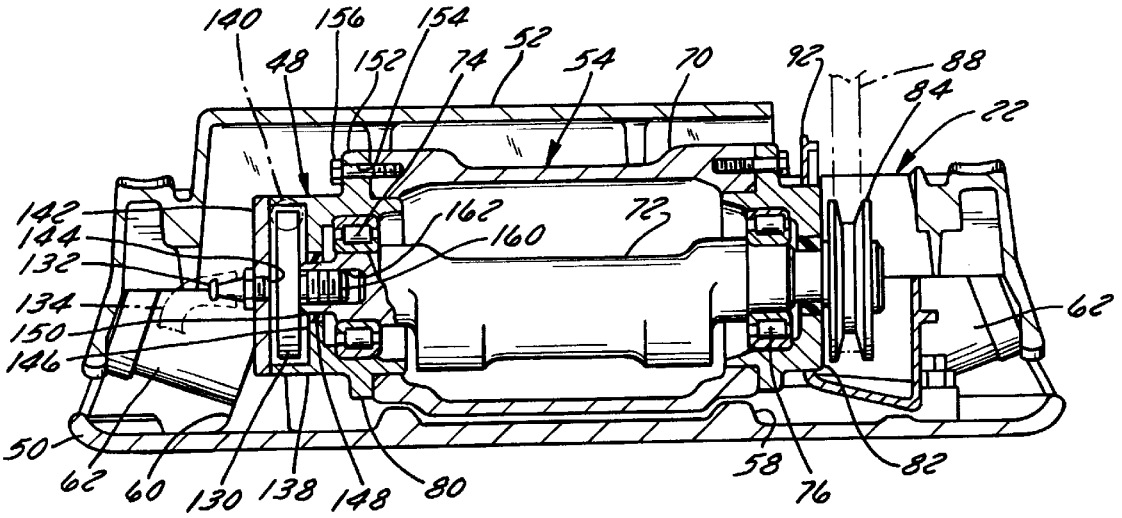
FIG. 3 is an end sectional elevation view of a console/baseplate/exciter assembly of the asphalt vibratory plate machine of FIG. 1, taken through the exciter of the assembly.

Referring now to the drawings and initially to FIGS. 1–5 in particular, an asphalt vibratory plate machine 20 is illustrated that is suitable for smoothing and/or compacting (henceforth referred to as "compacting" for the sake of simplicity) virtually any granular material such as sand, gravel, aggregate, etc. It is particularly well suited for compacting hot or cold mix asphalt because it incorporates a water supply system. The machine 20 can be conceptually separated into four distinct assemblies, namely: a console/baseplate/exciter assembly 22 (the individual components of which are best seen in FIGS. 1–3); a torque generation assembly 24 (the individual components of which are best seen in FIGS. 1 and 2); a cage assembly 26 (the individual components of which are best seen in FIG. 1); and a water supply system 30 (the individual components of which are best seen in FIGS. 2–7). The machine 20 is designed for relatively small scale industrial operations in which an operator walks behind the machine 20 and guides and propels the machine 20 using a handle assembly 28 connected to the console 52 of the console/baseplate/exciter assembly 22.

The handle assembly 28 is formed from a single U-shaped tubular metal member so as to form first and second relatively long side legs 32 and 34 and a center handle 36 connecting the upper end of the side legs 32 and 34 to one another. As best seen in FIGS. 1 and 2, the bottom of each of the side legs 32 and 34 is pivotally attached to the console 52 by a pivot assembly. Each pivot assembly includes a sleeve 38 welded to the bottom end of the side leg 32 or 34, one or more bushings (not shown) concentrically received in the sleeve 38, and a pivot pin 40 that extends through the bushing and is threaded into an intermediate sidewall of the console 52. The side legs 32 and 34 are bridged near their upper end by a metal plate 42 that serves as a mounting surface for instructions and other indicia and that helps damp vibrations that would otherwise be imposed on the operator's hands.

The console/baseplate/exciter assembly 22, torque generation assembly 24, and cage assembly 26 are described in greater detail in a separate application filed simultaneously herewith and entitled "VIBRATORY PLATE MACHINE", the disclosure of which is hereby incorporated by reference in its entirety for the sake of completeness. Each of these assemblies will be described herein briefly for the sake of clarity.

The console/baseplate/exciter assembly 22 includes a baseplate 50, a console 52 mounted on the baseplate 50, and an exciter 54 mounted on the baseplate 50 beneath the console 52. The baseplate 50 is formed from a single nodular ductile iron plate having a bottom compacting surface and an upper surface on which are mounted a plurality of reinforcing ribs 56, an exciter mount frame 58, and four shockmount bosses 60. Shockmounts 62 are bolted to the bosses 60 by studs (not shown). The console 52 is attached to the shockmounts 62 by bolts 64 to support the console 52 on the baseplate 50 in an overlying relationship with respect to the exciter 54.

Referring to FIGS. 2–5, the exciter 54 includes a housing 70 and a metal eccentric shaft 72 rotatably supported in the housing 70 by bearings 74 and 76. The housing 70 is generally cylindrical, extends most of the length of the shaft 72, and overlies the shaft 72 so as to be connectable to the mount frame 58 by bolts 78 best seen in FIG. 2. End caps 80 and 82, bolted to the opposed ends of the housing 70, support the bearings 74 and 76. Both ends of the eccentric shaft 72 extend beyond the bearings 74 and 76 and the end caps 80 and 82. One end extends through the second end cap 82 and receives a driven pulley 84 for connection to the torque generation assembly 24 as detailed below. The other end receives the impeller 130 of the pump 48 of the water supply system 30 also as detailed below.

The torque generation assembly 24 includes an engine 86, a clutch (not shown), and a torque transmitting member in the form of a V-belt 88 coupling the clutch to the driven pulley 84 of the exciter 54. The engine 86 is a conventional, relatively small (on the order of six horsepower) gasoline powered engine bolted on the upper surface of the console 52. The clutch is a high inertia, negative engaging-type clutch in which engagement occurs automatically upon engine output shaft acceleration. The V-belt 88 extends from the drive pulley of the clutch to the driven pulley 84 of the exciter 54 to transfer torque to the exciter 54. A belt guard 90 surrounds the clutch and is connected to a mounting plate 92 (FIG. 3) disposed in front of the clutch. The mounting plate 92 is bolted to the engine 86 and to the console 52 in a manner that is not illustrated.

The cage assembly 26 is designed to effectively encase the engine 86 and the storage tank 44 so as to protect them from damage should the machine 20 be tipped over or otherwise be subjected to external shocks. The cage assembly 26 includes first and second side braces 94, 96 connected to one another by a plurality of crossbars 98, 100, 102, and 104. The side braces 94 and 96 are bent into a generally n-shaped profile so as to encase both the engine 86 and the storage tank 44. The crossbars 98, 100, 102, and 104 are configured to facilitate lifting the machine 20. At least some of them may have metal inserts or other weight enhancing devices for vibration damping purposes. The cage assembly 26 is mounted on the console 52 via 1) rear mounting brackets 106 attached to the rear ends of the side braces 94 and 96 and 2) a front bracket 108 attached to the front cross bar 104.

3. Construction of Water Supply System

The water supply system 30 (FIGS. 2–7) is designed to spray a lubricant, typically water, onto the asphalt surface directly in front of the machine 20 so that the asphalt does not congeal on the baseplate 50. The water supply system 30 is configured to apply a uniform spray pattern regardless of the lubricant level in the storage tank 44 or of the inclination of the machine 20. The water supply system 30 includes 1) a storage tank 44 located on the console 52 of the console/baseplate/exciter assembly 22 directly in front of the torque generation assembly 24, 2) a nozzle assembly 46 mounted on the baseplate 50, and 3) a pump 48 that routes water from the storage tank 44 to the nozzle assembly 46.

Figure 4:
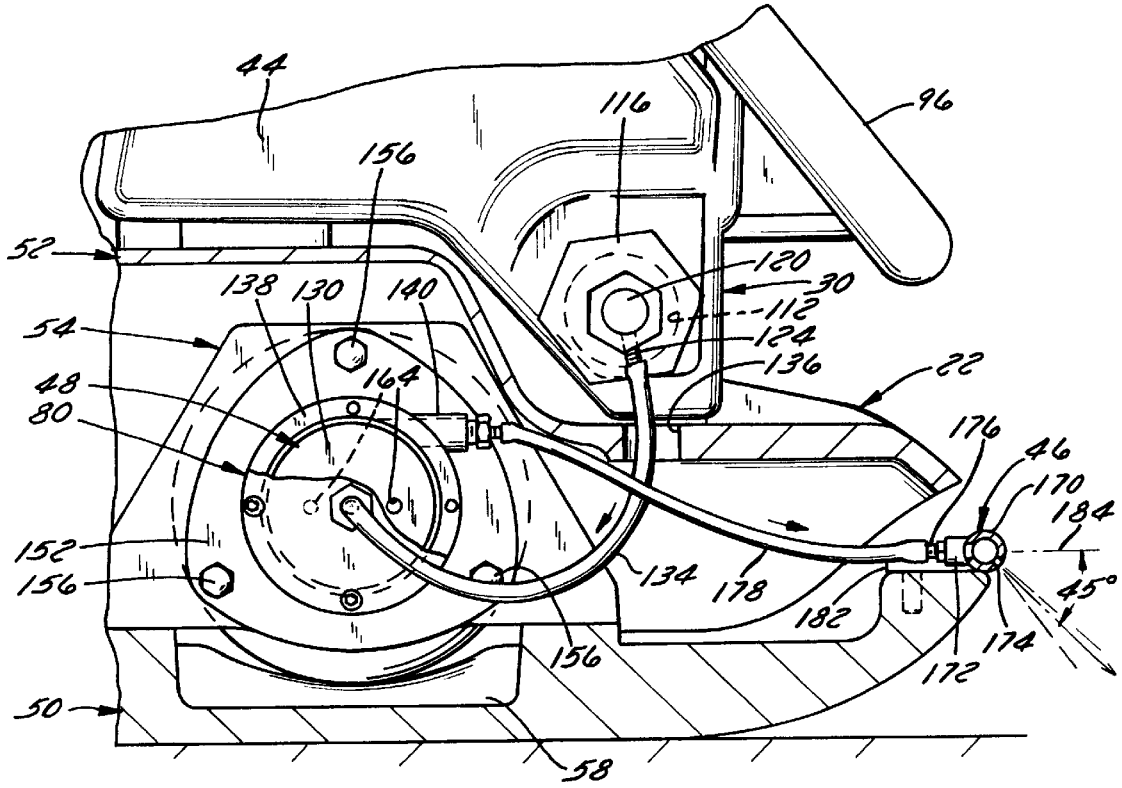
FIG. 4 is a sectional, partially cut-away side elevation view of a portion of the asphalt vibratory plate machine of FIGS. 1–3 including the majority of a water supply system of the machine.
Figure 5:
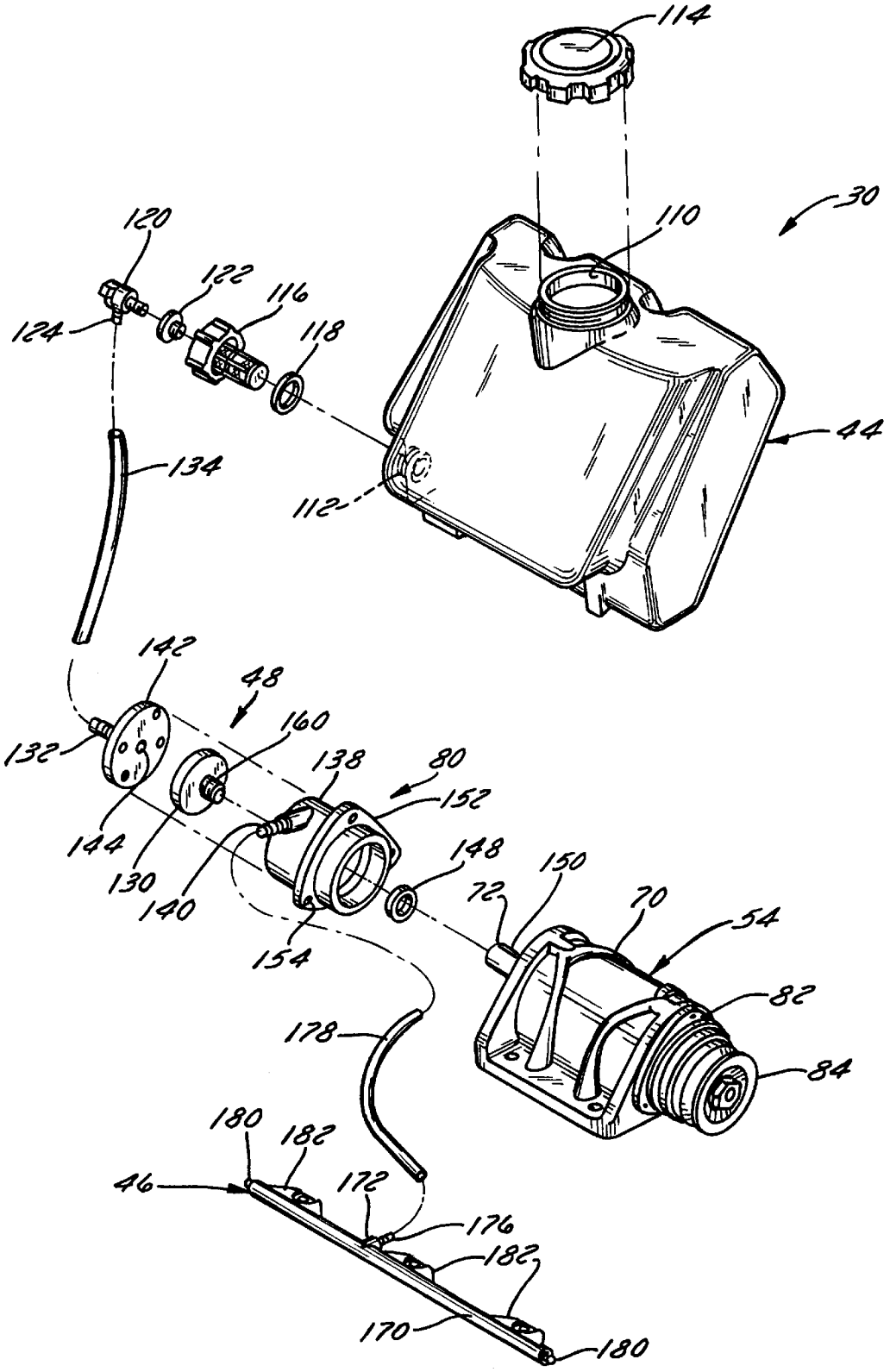
FIG. 5 is an exploded perspective view of the water supply system of the asphalt vibratory plate machine of FIGS. 1–4.

The storage tank 44 includes a plastic tank configured to generally compliment the shape of the front of the engine 86 and to rest on the console 52 to which it is bolted or otherwise attached. The storage tank 44 includes an upper fill opening or inlet 110 and a lower outlet 112. Referring especially to FIG. 5, the inlet 110 is normally covered by a cap 114 which can be selectively removed to fill the storage tank 44. A filter 116 is inserted into the outlet 112 and is sealed to the storage tank 44 by a seal ring 118. A shut-off valve 120 is inserted into the outer end of the filter 116 via an intermediate bushing 122. The shut-off valve 120 can be manually actuated to selectively open and close an internal passage to selectively permit and prohibit the flow of water through a discharge fitting 124 of the valve 120. The pump 48 need only be powerful enough to pressurize the water flowing from the storage tank 44 sufficiently to eliminate or at least reduce variations in flow rates that might otherwise occur with variations in lubricant level within the storage tank 44 or with variations of machine inclination. It has been discovered that sufficient pressure to meet this goal can be obtained via a relatively small, inexpensive, and easy-to-fabricate and assemble pump 48 driven directly by the eccentric shaft 72 of the exciter 54. Referring particularly to FIGS. 2–5, the pump 48 is a simple centrifugal pump including 1) a volute casing and 2) an impeller 130 positioned within the volute casing and driven directly by the eccentric shaft 72. An inlet 132 of the pump 48 is connected to the outlet fitting 124 of the shut-off valve 120 by a tube 134 extending through an opening 136 formed in the console 52 as best seen in FIG. 4.

The volute casing is preferably formed integrally with the end cap 80 to facilitate assembly and to render the pump 48 as small as practical so as not to require modification of the remainder of the machine 20. The volute casing/end cap 80 includes a generally tubular body 138 having an outer axial end, an inner axial end, and a radial outlet 140 which forms an outlet of the pump 48. An outer axial end wall 142 of the volute casing/end cap 80 is bolted to the axial end of the body 138 and has a central opening 144 formed therein which receives a fitting forming the inlet 132 of the pump 48. An inner axial wall 146, preferably formed integrally with the body 138, is disposed axially-inwardly of the outer axial wall 142 and extends radially inwardly from the tubular body 138. The inner axial wall 146 has a central opening formed therein which receives a seal ring 148 that sealingly engages a reduced diameter portion 150 of the eccentric shaft 72 disposed axially-outwardly of the bearing 74. The bearing 74 is supported in a race of the body 138 located axially-inwardly from and adjacent to the inner axial wall 146. A volute is formed between the inner and outer axial walls 146 and 142 of the volute casing/end cap 80 and is dimensioned to receive the impeller 130 with a slight axial and radial clearance. Finally, an annular mount flange 152 is provided for attaching the volute casing/end cap 80 to the exciter housing 70. The mount flange 1) is disposed axially between the inner axial wall 146 and the inner axial end of the body 138, 2) extends radially outwardly from the body 138, and 3) has holes 154 formed therein for receiving bolts 156 for connection to the axial end of the exciter housing 70.

The impeller 130 is a flat disk type impeller formed from any suitable material. Although a metal such as steel could be used to form the impeller 130, nylon is currently preferred because 1) it will not corrode, 2) it is inexpensive, and 3) it presents a relatively high frictional coefficient as compared to steel and hence facilitates the operation of the disk as an impeller despite the fact that it has no vanes. An externally threaded shank 160 extends axially rearwardly from the central portion of the impeller 130. The shank 160 is threaded into an internally threaded axial bore 162 of the eccentric shaft 72 so that the impeller 130 rotates with the eccentric shaft 72. The threads extend in a direction opposite to the direction of rotation of the eccentric shaft 72 so that the impeller 130 does not work loose during operation of the machine 20. Attachment of the impeller 130 to the shaft 72 is facilitated by a pair of spaced recesses 164 formed in the outer axial surface of the impeller 130 and configured to receive a spanner wrench.

Figure 6:
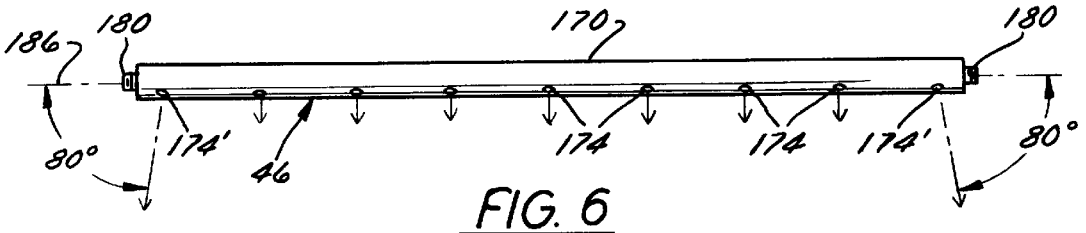
FIG. 6 is a front elevation view of the nozzle assembly of the water supply system of FIGS. 4 and 5 taken generally along the lines 6—6 in FIG. 2.

The nozzle assembly 46 is configured to spray lubricant onto the asphalt surface in a uniform pattern directly in front of the baseplate 50. The nozzle assembly could take many forms including, for example, one or a plurality of nozzles mounted on a support that is attached to the console or cage at a location above the baseplate. Such a configuration has some attraction because it locates the nozzle at a location well above the asphalt surface in which clogging from asphalt is unlikely. However, in the illustrated and currently-preferred embodiment, the nozzle assembly 46 includes a spray bar in the form of a plastic or metal tube 170 having 1) a central axial inlet 172 and 2) a plurality of longitudinally spaced spray orifices 174, 174' (as best seen in FIG. 6). A fitting 176 extends from the inlet 172 for connection to one end of a tube 178 the opposite end of which is connected to the fitting forming the outlet 140 of the pump 48. The longitudinal ends of the tube 170 are plugged using plugs 180. Three spaced mounting brackets 182 are formed integrally with and extend rearwardly from the tube 170 as best seen in FIGS. 4 and 5 for receiving bolts that connect the tube 170 to the front end of the baseplate 50 as best seen in FIG. 4.

Figure 7:
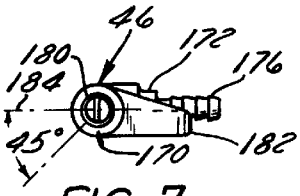
FIG. 7 is an end elevation view of the nozzle assembly of FIG. 6.

Turning now to FIGS. 6 and 7, the spray orifices 174, 174' are designed to produce a uniform spray pattern across the entire width of the compaction path. The spray orifices are also designed to permit the spray bar or tube 170 to be substantially shorter than the lateral width of the baseplate 50 (as best seen in FIGS. 1 and 2) so that the spray bar does not snare on and become damaged by obstructions in the vicinity of the machine 20. Towards these ends, and referring to FIGS. 6 and 7, the spray orifices 174, 174' are provided in longitudinal alignment with one another and are evenly spaced along the length of the tube 170. Nine spray orifices are provided in the illustrated embodiment, but the number could vary depending upon the size of the machine 20 and the spray pattern desired. The spray orifices 174, 174' are formed by drilling holes into the tube 170. Each of the spray orifices 174, 174' extends outwardly at an acute angle with respect to a horizontal plane 184 bisecting the spray orifices 174, 174' so that water is discharged forwardly and downwardly with respect to the tube 170. This angle is 45° in the illustrated embodiment, but it may vary depending upon the shape and size of the baseplate 50 and the location of the tube 170 on the baseplate 50. Most of the spray orifices 174 extend radially with respect to a longitudinal centerline 186 of the tube 170. However, in order to permit the tube 170 to be shorter than the lateral width of the baseplate 50 while still permitting lubrication of the entire compaction path of the machine 20, the two outermost orifices 174' extend laterally outwardly at an acute angle with respect to the longitudinal centerline 186 of the tube 170. This angle is 80° in the illustrated embodiment but could vary depending upon the length of the tube 170 relative to the width of the baseplate 50 and upon the locations of the end orifices 174' relative to the ends of the tube 170.

4. Operation of Vibratory Plate Machine

The vibratory plate machine 20 is operated by starting the engine 86 and supplying sufficient throttle to effect clutch engagement, at which point torque is transferred from the clutch (not shown) to the exciter 54 by way of the V-belt 88. Rotation of the eccentric shaft 72 of the exciter 54 imparts vibrations to the baseplate 50 to compact material in a manner that is, per se, well known. The operator then guides and moves the machine 20 along an intended compaction path using the handle assembly 28.

The water supply system 30 sprays water onto the asphalt surface directly in front of the machine 20 to prevent asphalt from congealing on the baseplate 50. Specifically, rotation of the eccentric shaft 72 of the exciter 54 causes the impeller 130 of the pump 48 to rotate within the volute casing/end cap 80 thereby drawing water from the storage tank 44, through the filter 116 and valve 120, through the tube 134, and into the volute casing/end cap 80 through the inlet 132. Friction between the nylon disk of the impeller 130 and the water forces the water through the volute, radially out of the outlet 140 of the casing/end cap 80, and into the spray bar or tube 170 of the nozzle assembly 46 through the tube 178. Water is discharged from the spray orifices 174, 174' of the spray bar or tube 170 at an acute angle so as to spray a generally uniform pattern onto the entire width of the compaction path as best seen in FIG. 4. The pressure generated by the pump 48 is sufficient to alleviate the differences in flow rate that otherwise would occur due to variations in the level of water or other lubricant in the storage tank 44 and/or due to differences in inclination of the machine 20. In the illustrated embodiment, this pressure is approximately 10–15 psi.

Many changes and modifications may be made within the scope of the present invention without departing from the spirit thereof. The scope of these changes will become apparent from the attached claims.

I claim:

1. A lubricant supply system for an asphalt vibratory plate machine, the asphalt vibratory plate machine being configured to smooth and compact an asphalt surface and including a baseplate, an exciter which is located above the baseplate and which imparts a vibratory motion to the baseplate, and a console which is mounted on an upper surface of the baseplate and which overlies the exciter said lubricant supply system comprising:

(A) a storage tank which is configured for mounting on the console and which has an outlet formed therein;

(B) a nozzle assembly which is configured to spray lubricant on the asphalt surface in front of the asphalt vibratory plate machine, said nozzle assembly having an inlet and at least one spray orifice; and (C) a pump which has an inlet in fluid communication with said outlet of said storage tank and an outlet in fluid communication with said inlet of said nozzle assembly, wherein said pump is configured to be driven by the exciter.

2. A lubricant supply system as defined in claim 1, wherein said pump comprises an impeller which is fixable to an end portion of an eccentric shaft of the exciter so as to rotate with the eccentric shaft.

3. A lubricant supply system as defined in claim 2, wherein said pump further comprises a volute casing which forms an end cap of a housing of the exciter and which has a volute formed therein in which is disposed said impeller, said volute casing including 1) a generally tubular body having an outer axial end, an inner axial end, and a radial outlet which forms said outlet of said pump, 2) an outer axial wall covering said outer axial end of said tubular body and having an axial inlet formed therein which forms said inlet of said pump, 3) an inner axial wall disposed axially-inwardly of said outer axial wall and extending radially-inwardly from said tubular body, said inner axial wall having a central opening formed therein which sealingly surrounds the end portion of the eccentric shaft, said volute being formed axially between said outer axial wall and said inner axial wall, and 4) an annular mount flange disposed axially between said inner axial wall and said inner axial end of said tubular body, said annular mount flange extending radially outwardly from said tubular body and having holes formed therein for connecting said mount flange to a body of the housing of the exciter.

4. A lubricant supply system as defined in claim 2, wherein said impeller comprises a flat disk.

5. A lubricant supply system as defined in claim 4, wherein said impeller is threadable onto the end portion of the eccentric shaft, and wherein openings are formed in an outer axial surface of said impeller for receiving a spanner wrench.

6. A lubricant supply system as defined in claim 2, wherein said impeller is formed from nylon.

7. A lubricant supply system as defined in claim 1, wherein said nozzle assembly comprises a tubular spray bar which is configured for mounting on the baseplate of the asphalt vibratory plate machine proximate a front edge surface thereof, said spray bar comprising an inlet which 1) is in fluid communication with said outlet of said pump and 2) forms said inlet of said nozzle assembly, said spray orifice of said nozzle assembly being formed in a lower portion of said spray bar, a plurality of additional spray orifices being formed in said lower portion of said spray bar in a longitudinally spaced relationship to said spray orifice.

8. A lubricant supply system as defined in claim 7, wherein said spray orifices extend forwardly at an acute angle with respect to a vertical plane bisecting said spray bar.

9. A lubricant supply system as defined in claim 7, wherein said spray bar is shorter than a lateral width of the baseplate, and wherein said spray orifices include first and second outermost end orifices and a plurality of intermediate orifices located longitudinally between said first and second outermost end orifices, said first and second outermost end orifices extending laterally outwardly at an acute angle with respect to a longitudinal centerline of said spray bar, said intermediate orifices extending radially with respect to said longitudinal centerline of said spray bar.

10. A lubricant supply system for an asphalt vibratory plate machine, the asphalt vibratory plate machine being configured to smooth and compact an asphalt surface and including a baseplate, an exciter which is located above the baseplate and which imparts a vibratory motion to the baseplate, and a console which is mounted on an upper surface of the baseplate and which overlies the exciter, said lubricant supply system comprising:

(A) a storage tank which is configured for mounting on the console and which has an outlet formed therein;

(B) a nozzle assembly which is configured to spray lubricant on the asphalt surface in front of the asphalt vibratory plate machine, said nozzle assembly having an inlet and at least one spray orifice; and (C) a pump which has an inlet in fluid communication with said outlet of said storage tank and an outlet in fluid communication with said inlet of said nozzle assembly, wherein said pump includes (1) an impeller which comprises a flat disc and a threaded shank extending axially inwardly from said flat disc for connection to an end portion of an eccentric shaft of the exciter so as to rotate with the eccentric shaft, and (2) a volute casing which forms an end cap of a housing of the exciter and which has a volute formed therein in which is disposed said impeller, said volute casing including (a) a generally tubular body having an outer axial end, an inner axial end, and a radial outlet which forms said outlet of said pump, (b) an outer axial wall covering said outer axial end of said tubular body and having an axial inlet formed therein which forms said inlet of said pump, (c) an inner axial wall disposed axially-inwardly of said outer axial wall and extending radially-inwardly from said tubular body, said inner axial wall having a central opening formed therein which sealingly surrounds the end portion of the eccentric shaft, said volute being formed axially between said outer axial wall and said inner axial wall, and (d) an annular mount flange disposed axially between said inner axial wall and said inner axial end of said tubular body, said annular mount flange extending radially outwardly from said tubular body and having holes formed therein for connecting said mount flange to a body of the housing of the exciter.

11. An asphalt vibratory plate machine comprising:

(A) a baseplate having a lower surface which compacts materials, an upper surface, and a front side surface;

(B) an exciter which is located above said baseplate and which imparts a vibratory motion to said baseplate;

(C) a console which is mounted on said upper surface of said baseplate and which overlies said exciter; and (D) a lubricant supply system including (1) a storage tank which is mounted on said console and which has an outlet formed therein, (2) a nozzle assembly which is configured to spray lubricant on the asphalt surface in front of the asphalt vibratory plate machine, said nozzle assembly having an inlet and at least one spray orifice, and (3) a pump which has an inlet in fluid communication with said outlet of the said storage tank and an outlet in fluid communication with said inlet of said nozzle assembly, wherein said pump is configured to be driven by said exciter.

12. A lubricant supply system as defined in claim 11, wherein said exciter comprises 1) an eccentric shaft rotatably supported on a pair of opposed bearings, and 2) a housing including a) a generally cylindrical body which surrounds said eccentric shaft and which has an axial end and b) an end cap which is bolted to said axial end of said body, and wherein said pump comprises:

an impeller which is fixed to an end portion of said eccentric shaft of said exciter so as to rotate with said eccentric shaft, and a volute casing which is formed integrally with said end cap of said housing and which has a volute formed therein in which is disposed said impeller, said volute casing including 1) a generally tubular body having an outer axial end, an inner axial end, and a radial outlet which forms said outlet of said pump, 2) an outer axial wall covering said outer axial end of said tubular body and having an axial inlet formed therein which forms said inlet of said pump, 3) an inner axial wall disposed axially-inwardly from said tubular body, said inner axial wall having a central opening formed therein which sealingly surrounds said end portion of said eccentric shaft, said volute being formed axially between said outer axial wall and said inner axial wall, and 4) an annular mount flange disposed axially between said inner axial wall and said inner axial end of said tubular body, said annular mount flange extending radially outwardly from said tubular body and having holes formed therein for connecting said mount flange to said body of said housing of said exciter.

13. An asphalt plate finishing machine as defined in claim 11, wherein said nozzle assembly comprises a tubular spray bar which is configured for mounting on the baseplate of the asphalt vibratory plate machine proximate a front edge surface thereof, said spray bar comprising an inlet which is coupled to said outlet of said pump by a tube and which forms said inlet of said nozzle assembly, said spray orifice of said nozzle assembly being formed in a lower portion of said spray bar, a plurality of additional spray orifices being formed in said lower portion of said spray bar in a longitudinally spaced relationship to said spray orifice.

14. An asphalt vibratory plate machine as defined in claims 13, wherein said spray orifices extend forwardly at an acute angle with respect to a horizontal plane bisecting said spray bar, and wherein said spray bar is shorter than a lateral width of the baseplate, and said spray orifices include first and second end orifices and a plurality of intermediate orifices located longitudinally between said first and second end orifices, said first and second end orifices extending laterally outwardly at an acute angle with respect to a longitudinal centerline of said spray bar, said intermediate orifices extending radially with respect to said longitudinal centerline of said spray bar.

15. A method of compacting an asphalt surface, said method comprising the steps of:

(A) propelling a vibratory plate machine over the asphalt surface, the vibratory plate machine including a baseplate and an exciter which is located above said baseplate;

(B) as said vibratory plate machine is being propelled over the asphalt surface, imparting a vibratory motion to said baseplate using said exciter; and (C) as said vibratory plate machine is being propelled over the asphalt surface, spraying lubricant onto the asphalt surface in front of said baseplate, said spraying step including (1) drawing lubricant from a storage tank and into a pump, said storage tank and said pump both being supported at least indirectly by said baseplate, then (2) forcing lubricant from said pump to a nozzle assembly located adjacent a front edge surface of said baseplate, and then (3) discharging lubricant from said nozzle assembly and onto the asphalt surface, wherein the steps of drawing lubricant and forcing lubricant are performed by driving said pump by said exciter.

16. A method as defined in claim 15, wherein the step of driving said pump by said exciter comprises rotating a flat-disc type impeller of said pump by rotating an eccentric shaft of said impeller, said impeller being fixedly attached to an end of said eccentric shaft, said impeller being housed in a volute casing formed integrally with an end cap of said exciter.

17. A method as defined in claim 15, wherein the step of spraying lubricant includes forcing lubricant into an inlet of a tubular spray bar of said nozzle assembly and then discharging lubricant from a plurality of longitudinally-spaced spray orifices formed in a lower portion of said spray bar, wherein said spray orifices extend forwardly at an acute angle with respect to a horizontal plane bisecting said spray bar, and wherein said spray orifices include first and second end orifices and a plurality of intermediate orifices located longitudinally between said first and second end orifices, said first and second end orifices extending laterally outwardly at an acute angle with respect to a longitudinal centerline of said spray bar, said intermediate orifices extending radially with respect to said longitudinal centerline of said spray bar.

* * * * *